US005309741A

United States Patent [19]

Nava

[11] Patent Number: 5,309,741

[45] Date of Patent: May 10, 1994

[54] PADLOCK WITH KEY INDICATOR

[76] Inventor: Henry P. Nava, 443 Potrero Grande Dr., Monterey Park, Calif. 91754

[21] Appl. No.: 58,312

[22] Filed: May 10, 1993

Related U.S. Application Data

[63] Continuation of Ser. No. 993,646, Dec. 21, 1992.

[51] Int. Cl.[5] ..... E05B 15/08

[52] U.S. Cl. ..... 70/38 B; 70/55; 70/454; 40/299

[58] Field of Search ..... 70/38 R, 38 A, 38 B, 70/38 C, 39, 51, 54–56, 438–441, 453, 454, 460; 40/299, 634

[56] References Cited

U.S. PATENT DOCUMENTS

| | | | |
|---|---|---|---|
| 952,254 | 3/1910 | Jackson | 70/453 |
| 1,316,663 | 9/1919 | Zadorozny | 70/51 |
| 1,527,336 | 2/1925 | Voda | 70/39 |
| 1,751,153 | 3/1930 | Hauser | 70/454 |
| 1,868,563 | 7/1932 | Cicourel | 70/460 |
| 2,632,266 | 3/1953 | Sellwood | 70/454 |
| 4,112,715 | 9/1978 | Uyeda | 70/38 A |
| 4,253,321 | 3/1981 | Sorensen | 70/456 R |
| 4,317,344 | 3/1982 | Barnard | 70/55 |
| 4,913,981 | 4/1990 | Hynes et al. | 40/299 X |
| 5,109,686 | 5/1992 | Toussant | 70/454 |

FOREIGN PATENT DOCUMENTS

| | | | |
|---|---|---|---|
| 823431 | 10/1936 | France | 70/454 |
| 1147113 | 2/1956 | France | 70/454 |

*Primary Examiner*—Peter M. Cuomo
*Assistant Examiner*—Suzanne L. Dino
*Attorney, Agent, or Firm*—William W. Haefliger

[57] ABSTRACT

A padlock having a body, a U-shaped keeper at one end of the body, and a key receptor at the opposite end of the body, the body containing a row of pieces to be engaged by key teeth comprising an indicator device on the body; the device having a location on the body relative to the pieces to indicate the left or right directional orientation of key teeth insertion into the receptor, to effect opening of the padlock keeper; and the indicator device extending in the direction of key insertion.

8 Claims, 2 Drawing Sheets

FIG. 6.
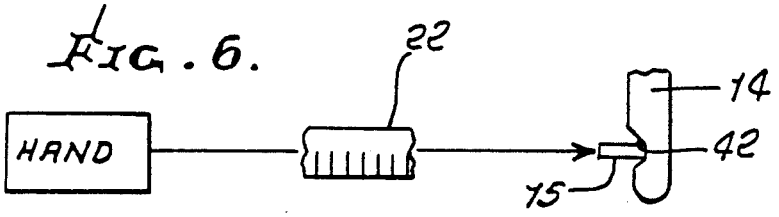
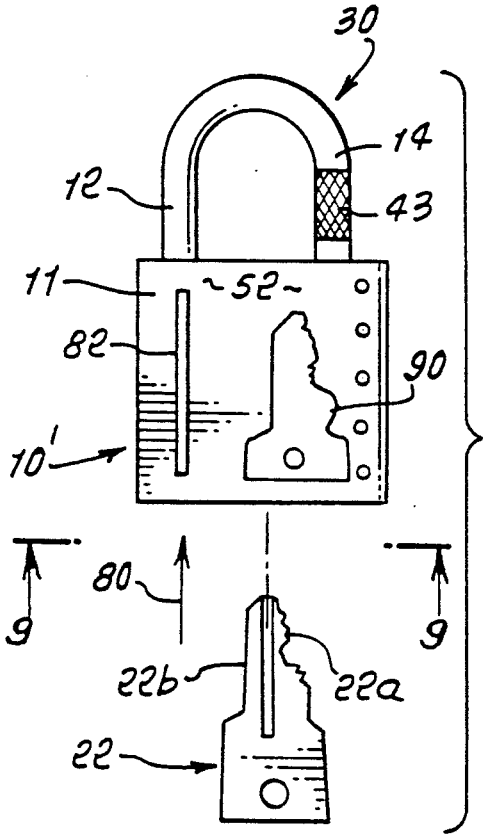
FIG. 8.
FIG. 7.
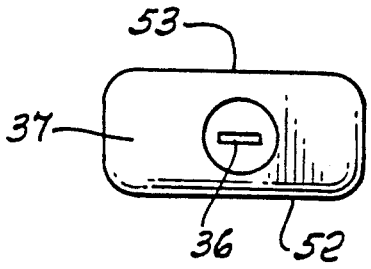
FIG. 10.
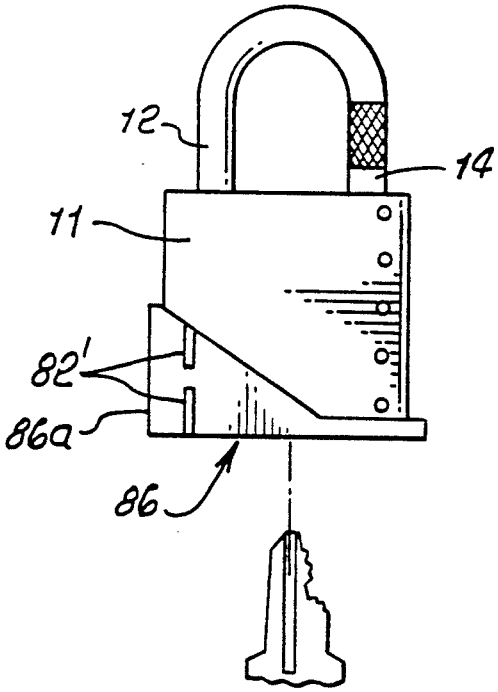
FIG. 9.
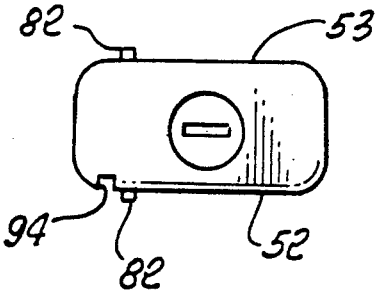

PADLOCK WITH KEY INDICATOR

BACKGROUND OF THE INVENTION

This application is a continuation-in-part of Ser. No. 993,646 filed Dec. 21, 1992 allowed.

The present invention relates generally to padlocks, and particularly to those having a built-in or accessory indicator to indicate to the user how he should position the padlock key in order to open the lock.

A conventional key-operated padlock comprises a body containing a key receptor cylinder and an attached U-shaped keeper in the form of a shackle, chain, or cable, or varied combinations of such components. The keeper parts are attached to the body at one end, or both ends, becoming secured to the body when the lock is in a closed, locked position.

The conventional locked padlock requires for its opening that a key be inserted into a key cylinder in the body of the lock. The key cylinder typically has pins that are presented to be actuated by the key teeth into a specific position which releases one or both ends of the retaining shackle or keeper.

Conventional padlocks do not assist the user to position the key in the user's hand in the proper manner so as to always insert the key into the key slot with the key teeth presented to engage the pins. Only one half of the time can the user guess which direction to point the teeth of the key for the key to enter. The other half of the time the user must take the time to revolve the key 180 degrees in his hand prior to insertion of the key.

There is need for means to indicate which direction the teeth or notches of the key must face in order to enter the keyway; however, there is, at present, no instruction, attachment, guide, or visual configuration on the lock to tell the user how to properly position the key in his hand to enable the key to enter the slot.

SUMMARY OF THE INVENTION

It is a major object of the invention to provide means to meet the above-described need, and to overcome the key orientation problem, in a simple, effective manner. Basically, the invention is embodied in a padlock having a body, a U-shaped keeper at one end of the body, and a key receptor at the opposite end of the body, the body containing a row of pins to be engaged by key teeth. In this environment, the invention comprises:

a) an indicator device on the body, b) the device having a physical feature located on the body relative to the pins to indicate the left or right directional orientation of key teeth insertion into the receptor, to effect opening of the padlock keeper.

As will be seen, the indicator means typically and advantageously comprises notch means on the body, the notch means preferably including a row of notches extending in the direction of key insertion, for ease of finger touching, as in the dark.

Accordingly, the padlock immediately indicates to the user the proper position in which to hold the key, in order to orient the teeth of the key so as to enter the key receptor slot. Such indication, by the appearance of the lock, occurs when the lock is in any position, when the lock is touched, or when the lock is located in a dark area and cannot be seen clearly but can be touched by the user. The notch means is such as to indicate, with no doubt, how the key must be held in order to enter the key slot and open the lock.

Other objects include the provision of notch means on the body close to one edge of the body; or on one leg of the U-shaped keeper closest to that side of the body toward which the key teeth must be presented for entry. In another form of the invention, the notch means is on a boot on the body.

Another object of the invention is to provide:

a) an indicator device on the body, b) the device having a location on the body relative to the pins to indicate the left or right directional orientation of key teeth insertion into the receptor, to effect opening of the padlock keeper, c) the indicator device extending in the direction of key insertion.

As will be seen, the device may typically present a shoulder extending in said direction; and the device may comprise a ridge or ledge extending at the side of the key receptor away from the key teeth.

These and other objects and advantages of the invention, as well as the details of an illustrative embodiment, will be more fully understood from the following specification and drawings, in which:

DRAWING DESCRIPTION

FIG. 6 is a schematic actuation diagram;

FIG. 7 is a view taken on lines 7—7 of FIG. 2.

FIG. 8 is a view like FIG. 1 showing a modified form of the device;

FIG. 9 is a view taken on lines 9—9 of FIG. 8; and

FIG. 10 is a view like FIG. 8 showing another modification.

DETAILED DESCRIPTION

Figure 1:
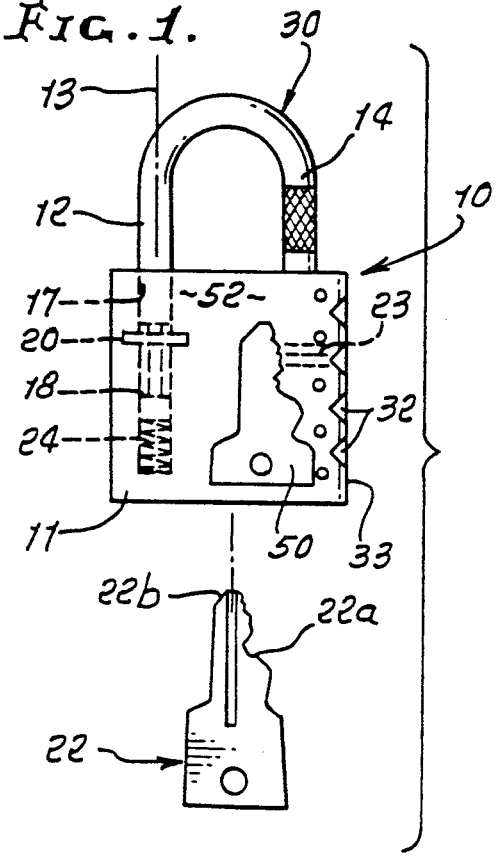
FIG. 1 is a side elevation showing one side of a padlock body.
Figure 2:
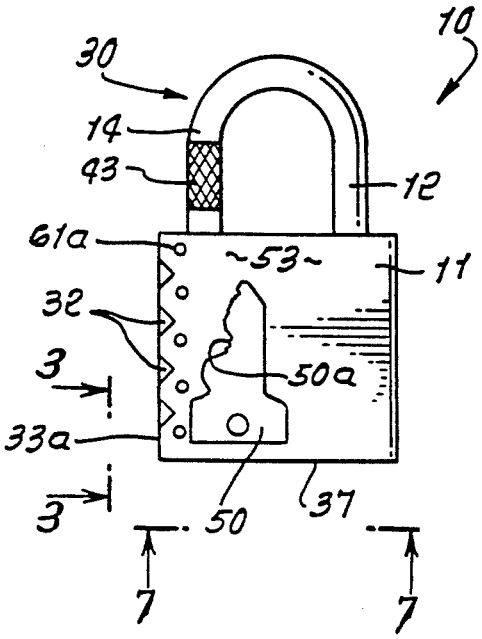
FIG. 2 is like FIG. 1 but showing the opposite side of the body.
Figure 3:
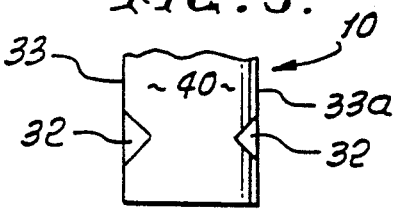
FIG. 3 is a view taken on lines 3—3 of FIG.

In FIGS. 1–3 and 7, a padlock 10 has a body 11, and a U-shaped keeper 30 at one end of the body. The keeper has one leg 12 received in a body bore, and retained to swivel about axis 13, and to move between upper and lower positions. In upper position, the keeper second leg 14 is "unlocked"; and in lower position, the keeper second leg 14 is latched by a key releasable dog 15, as seen in FIG. 6. FIG. 1 also shows a bore 17 in the body in which the lower end of leg 12 swivels. Stop shoulder 18 on the leg is engageable with a stop 20 in the body to limit up and down movement of the keeper and its legs. These showings are intended to be diagrammatic and to illustrate conventional padlock action.

In FIG. 6, the leg 14 has a side slot 42 in which spring-urged dog 15 enters. When key 22 is inserted into the padlock body to engage pins 23 in a row, the dog 15 retracts from slot 42 and releases leg 14, allowing the spring 24 in the body to push leg 12 and keeper 30 to unlocked position.

In accordance with the invention, an indicator device is provided on the body, the device having a location on the body relative to the pins to indicate the left or right directional orientation of key teeth insertion into the receptor, to effect opening of the padlock keeper. That device preferably comprises notch means on the body, as for example a row of notches located in proximity to an edge of the body toward which the key teeth are to be presented. As shown, the notches 32, in a row, are formed in an edge 33 of the body; the pins to be engaged by teeth 22*a* of key 22, are shown at 23.

Preferably, the V-notches 32 are cut into parallel edges 33 and 33*a* on opposite sides of the body (see FIGS. 1–3), to be readily felt by the user's fingers, groping in the dark, for example, so that no matter which side of the lock is presented, the user will be quickly able to discern the direction toward which the teeth 22*a* of the key must be laterally or sidewardly presented, as the tip 22*b* of the key is longitudinally inserted into the receptor opening 36 in the end 37 of the body. Notches may also be presented on the leg 14 closest the notched body side 40. The notches on the leg 14 may take the form of knurling 43 on and about that leg.

Also provided is a graphic representation 50 of a key applied to each side face 52 and 53 of the lock body, with teeth 50*a* presented toward notches 32. This also visually assists the user to properly orient his key, as shown, to engage the pins in the lock body. The representation 50 may be in the form of a label, engraving or decal, or other sheet, adhered to the body face.

Figure 4:
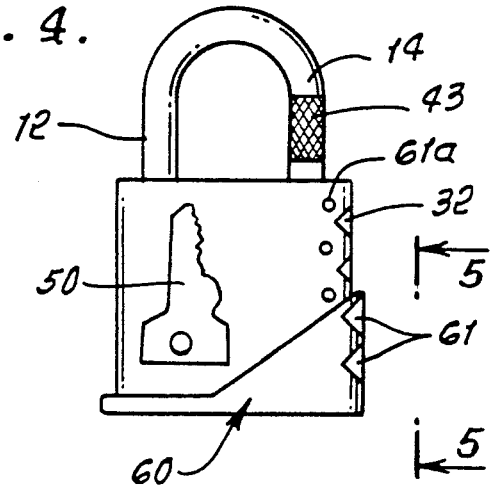
FIG. 4 is a view like FIG. 1 but showing a boot on the body with notch means.
Figure 5:
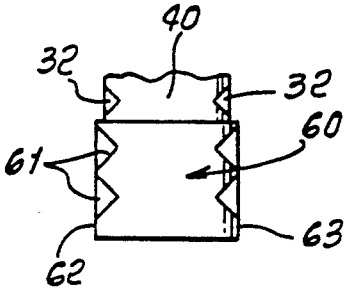
FIG. 5 is a view taken on lines 5—5 of FIG.

FIGS. 4 and 5 show a boot 60 attached to the lock body and having associated notches 61 on its corners 62 and 63 that overlie the body edges into which notches are cut. See also the representations 50, as in FIGS. 1 and 2. Boot 60 is elongated away from end 37 and at the body edge 33, which is notched. Such elongation also serves as an indicator, as referred to.

Referring again to FIGS. 1, 2 and 4, small projections or indentations 61*a* may be formed in the body sides 52 and 53, near edges 33 and 33*a*, to also serve as indicators. The user's fingers or the thumb may sense the locations of 61*a*, to enable correct key orientation, as referred to above, for notches 32.

In FIG. 8, the padlock 101 construction is the same as in FIG. 1 except that notches 32 are not used. Instead, an indicator device is employed on the body 11, that device extending in the direction 80 of key insertion; also, the device has a location on the body 11 relative to the pins 23 to indicate the left or right directional orientation of key 22*a* insertion into the receptor, to effect opening of the padlock keeper. See for example the device illustrated in the form of a ridge or ledge 82 on body side 52, or two such ledges 82 on body opposite sides 52 and 53, as appear in FIG. 9. Since ledges or ridges 82 are closer to the left side of face 83 of the body, they indicate, as by feel, that side face 83 toward which the straight (non-toothed) edge 22*b* of the key should be presented for proper insertion. The indicator device may also comprise an elongated (in direction 80) indentation 94, in face 52 and/or face 53. See FIG. 9.

Ridge or ledge 82 is also illustrative of a shoulder on body 11 extending in direction 80; and a similar ledge 82' may be formed on a boot 86, like boot 60, assembled onto the lower end of body 11, ledge 82' being shown in two elongated sections. Edge 86*a* of the boot may itself provide or add to the function of ledge 82. See FIG. 10. A graphic representation of a key 90 may be employed on the face 52, as in FIG. 1, and may also be employed on face 53.

I claim:

1. In combination with a padlock having a body, a U-shaped keeper at one end of the body, and a key receptor at the opposite end of the body, the body containing a row of pins to be engaged by key teeth, the combination comprising:

a) an indicator device on the body, b) said device having a location on the body relative to the pins to indicate the left or right directional orientation of key teeth insertion into said receptor, to effect opening of the padlock keeper, c) said indicator device extending in the direction of key insertion, d) said device presenting a shoulder extending in said direction, e) said shoulder being at the side of the key away from the key teeth.

2. The combination of claim 1 including knurling extending about one leg defined by said keeper, to provide an additional indicator.

3. The combination of claim 1 including a boot on the body and carrying said shoulder on the body.

4. In combination with a padlock having a body, a U-shaped keeper at one end of the body, and a key receptor at the opposite end of the body, the body containing a row of pins to be engaged by key teeth, the combination comprising:

a) an indicator device on the body, b) said device having a location on the body relative to the pins to indicate the left or right directional orientation of key teeth insertion into said receptor, to effect opening of the padlock keeper, c) said indicator device extending in the direction of key insertion, d) and including a graphic representation of a key on one side of the body, the representation having teeth presented away from said indicator device.

5. In combination with a padlock having a body, a U-shaped keeper at one end of the body, and a key receptor at the opposite end of the body, the body containing a row of pins to be engaged by key teeth, the combination comprising:

a) an indicator device on the body, b) said device having a location on the body relative to the pins to indicate the left or right directional orientation of key teeth insertion into said receptor, to effect opening of the padlock keeper, c) said indicator device extending in the direction of key insertion, d) said device defining a ridge presenting a shoulder extending in said direction on one side of the body, e) said device presenting a second shoulder on the opposite side of the body and extending in said direction.

6. The combination of claim 5 including graphic representation of keys on both sides of the body.

7. In combination with a lock having a body, a keeper at one end of the body, and a key receptor at the opposite end of the body, the body containing a row of pins to be engaged by key teeth, the combination comprising:

a) an indicator device on the body, b) said device having a location on the body relative to the pins to indicate the left or right directional orientation of key teeth insertion into said receptor, to effect opening of the keeper, c) said indicator device extending in the direction of key insertion, d) said indicator device comprising a row of shoulders proximate an edge of the body away from the key teeth.

8. The combination of claim 7 wherein said shoulders are formed by one of the following:

i) indentations in the body ii) projections on the body.

* * * * *